US007975755B2

(12) United States Patent
Schueren

(10) Patent No.: US 7,975,755 B2
(45) Date of Patent: Jul. 12, 2011

(54) METHOD AND APPARATUS FOR CONTINUOUSLY CASTING THIN STRIP

(75) Inventor: Mike Schueren, Crawfordsville, IN (US)

(73) Assignee: Nucor Corporation, Charlotte, NC (US)

( * ) Notice: Subject to any disclaimer, the term of this patent is extended or adjusted under 35 U.S.C. 154(b) by 50 days.

(21) Appl. No.: 12/364,840

(22) Filed: Feb. 3, 2009

(65) Prior Publication Data

US 2009/0159235 A1 Jun. 25, 2009

Related U.S. Application Data

(62) Division of application No. 11/419,346, filed on May 19, 2006, now Pat. No. 7,503,375.

(51) Int. Cl.
*B22D 11/06* (2006.01)

(52) U.S. Cl. ..... 164/480; 164/428

(58) Field of Classification Search ..... 164/480, 164/428

See application file for complete search history.

(56) References Cited

U.S. PATENT DOCUMENTS

| | | | | |
|---|---|---|---|---|
| 4,723,590 | A | 2/1988 | Yamauchi et al. | |
| 4,811,780 | A | 3/1989 | Yamauchi et al. | |
| 4,869,310 | A | 9/1989 | Yanagi et al. | |
| 5,058,657 | A | 10/1991 | Hasegawa et al. | |
| 5,060,714 | A | 10/1991 | Yamauchi et al. | |
| 5,207,265 | A | 5/1993 | Hasegawa et al. | |
| 5,318,097 | A * | 6/1994 | Blin et al. | 164/428 |
| 5,584,335 | A | 12/1996 | Barbe et al. | |
| 5,588,479 | A | 12/1996 | Leadbeatter et al. | |
| 5,787,968 | A | 8/1998 | Lauener | |
| 5,810,070 | A | 9/1998 | Osada et al. | |
| 5,915,454 | A * | 6/1999 | Wright et al. | 164/428 |
| 5,927,375 | A | 7/1999 | Damasse et al. | |
| 5,964,276 | A | 10/1999 | Dompas et al. | |
| 6,032,722 | A | 3/2000 | Russell et al. | |
| 6,073,680 | A | 6/2000 | Folder | |
| 6,079,480 | A | 6/2000 | Oka et al. | |
| 6,145,581 | A | 11/2000 | Takeuchi et al. | |
| 6,202,792 | B1 | 3/2001 | Cheong et al. | |
| 6,237,673 | B1 | 5/2001 | Kato et al. | |
| RE37,214 | E | 6/2001 | Barbe et al. | |
| 6,296,046 | B1 | 10/2001 | Jeong et al. | |
| 7,503,375 | B2 * | 3/2009 | Schueren | 164/428 |
| 7,556,084 | B2 * | 7/2009 | Bowman et al. | 164/428 |
| 2002/0079390 | A1 | 6/2002 | Jungling et al. | |

(Continued)

FOREIGN PATENT DOCUMENTS

| | | |
|---|---|---|
| EP | 0107970 | 5/1984 |

(Continued)

*Primary Examiner* — Kevin P Kerns
(74) *Attorney, Agent, or Firm* — Hahn Loeser & Parks LLP

(57) ABSTRACT

A method of producing thin cast strip by continuous casting having a two-piece side dam assembly. The side dam assembly includes a side dam having an upper portion positioned adjacent to a lower portion. The upper and lower side dam portions each have opposite outer surfaces, one surface capable of contacting molten metal and the opposite outer surface having at least one fastening portion capable of attaching the side dam portions to a corresponding side dam holder, in order to hold the side dam portions in place during casting without exposed portions of the side dam holders extending substantially beyond the opposite outer surfaces toward the outer surfaces capable of contacting molten metal, and without the side dam holders preventing the upper side dam portion from being properly positioned adjacent to the lower side dam portion.

11 Claims, 15 Drawing Sheets

U.S. PATENT DOCUMENTS

| | | | |
|---|---|---|---|
| 2006/0054298 | A1 | 3/2006 | Hohenbichler et al. |
| 2006/0081352 | A1 | 4/2006 | Demasse et al. |
| 2006/0102312 | A1 | 5/2006 | Poloni et al. |

FOREIGN PATENT DOCUMENTS

| | | |
|---|---|---|
| JP | 60-162558 | 8/1985 |
| JP | 61-037354 | 2/1986 |
| JP | 61042454 | 2/1986 |
| JP | 61144245 | 7/1986 |
| JP | 62064456 | 3/1987 |
| JP | 02099244 | 4/1990 |
| JP | 0813403 | 2/1996 |
| JP | 2000000641 | 1/2000 |
| WO | 9932247 | 7/1999 |
| WO | 2008106744 | 9/2008 |

* cited by examiner

METHOD AND APPARATUS FOR CONTINUOUSLY CASTING THIN STRIP

RELATED APPLICATIONS

This application is a divisional application of U.S. application Ser. No. 11/419,346 filed May 9, 2006 now U.S. Pat. No. 7,503,375.

BACKGROUND AND SUMMARY

In the continuous casting of steel, molten metal is cast directly into thin strip by a casting machine. The shape of the strip is determined by the mold of the casting machine, which receives the molten metal from a tundish and casts the metal into a generally thin strip. The strip may be further subjected to cooling and processing upon exit from the casting rolls.

In a twin roll caster, molten metal is introduced between a pair of counter-rotated horizontal casting rolls which are internally cooled so that metal shells solidify on the moving casting roll surfaces, and are brought together at the nip between the casting rolls to produce a thin cast strip product. The thin cast strip is delivered downwardly from the nip between the casting rolls. The term "nip" is used herein to refer to the general region at which the casting rolls are closest together. The molten metal may be poured from a ladle through a metal delivery system comprised of a tundish and a core nozzle located above the nip, to form a casting pool of molten metal supported on the casting surfaces of the rolls above the nip and extending along the length of the nip. This casting pool is usually confined between refractory side plates or dams held in sliding engagement with the end surfaces of the casting rolls so as to restrain the two ends of the casting pool.

When casting steel strip in a twin roll caster, the thin cast strip leaves the nip at very high temperatures, of the order of 1400° C. If exposed to normal atmosphere, it will suffer very rapid scaling due to oxidation at such high temperatures. A sealed enclosure that contains an atmosphere that inhibits oxidation of the strip is therefore provided beneath the casting rolls to receive the thin cast strip, and through which the strip passes away from the strip caster.

The length of a casting campaign of a twin roll caster has been generally determined in the past by the wear cycle on the core nozzle, tundish and side dams. Therefore, the focus of attention in the casting has been to extend the life cycle of the core nozzle, tundish and side dams, and thereby reducing the cost per ton of casting thin strip. When a nozzle, tundish or side dam wears to the point that one of them has to be replaced, the casting campaign has to be stopped, and the worn out component replaced. This generally involves replacing other unworn components as well, otherwise the length of the next campaign would be limited by the remaining useful life of the worn but not replaced refractory components. Graphite alumina, boron nitride and boron nitride-zirconia composites are examples of suitable refractory materials for the side dams, tundish and core nozzle components. Since the core nozzle, tundish and side dams all have to be preheated to very high temperatures approaching that of the molten steel, there is considerable waste of casting time between campaigns. See U.S. Pat. Nos. 5,184,668 and 5,277,243.

The side dams wear independently of the core nozzles and tundish, and independently of each other. During casting the side dams are initially urged against the ends of the casting rolls under applied forces, and "bedded in" by wear so as to ensure adequate seating against outflow of molten steel from the casting pool. The forces applied to the side dams are then reduced after an initial bedding-in period, however there is significant wear of the side dams throughout the casting operation. The core nozzle and tundish components in the metal delivery system usually have a longer potential life than the side dams, and could normally continue in service through several more ladles of molten steel if the useful life of the side dams could be extended. However, the tundish and core nozzle components, which still have useful life, are changed when the side dams are changed to increase the production capacity of the caster.

Previously, each side dam was generally held in place during casting by a side dam holder. The side dam typically included a V-shaped beveled bottom portion and the side dam holder typically included a V-shaped receptacle into which the V-shaped beveled bottom portion of the side dam was seated. The V-shape configuration served to position and hold the side dam in place during casting. However, such side dam assemblies limited the useful life of the side dams before causing serious damage to the casting equipment as well as adversely impacting the edges of the cast strip. Specifically, the degree of side dam wear had to be limited to prevent the clashing of the side dam holder V shaped receptacle with the casting roll edge, limiting the service life of the side dam. Therefore, the side dams were always replaced before such damage to casting equipment could occur, limiting the duration of the casting campaign. As explained above, when the side dams were changed, the removable tundish and core nozzle were generally also changed and a new casting campaign started. The casting costs per ton of thin strip cast thus could be considerably reduced if the useful life of the side dams could be extended.

In summary, no matter which refractory component has worn out first, a casting campaign will need to be terminated to replace the worn out component. Since the cost of thin cast strip production is directly related to the length of the casting time, unworn components in the metal delivery system are generally replaced before the end of their useful life as a precaution to avoid further disruption of the next casting campaign. This results in attendant waste of useful life of refractory components.

Further limitations and disadvantages of previously used and proposed thin strip casting systems and methods will become apparent to one of skill in the art, through comparison of such systems and methods with the present invention as set forth in this present application.

A method of producing thin cast strip by continuous casting is disclosed comprising the steps of:

a) assembling a pair of casting rolls having a nip therebetween, b) assembling a metal delivery system comprising side dams adjacent the ends of the nip to confine a casting pool of molten metal supported on casting surfaces of the casting rolls, where each side dam has an upper portion adjacent a lower portion as described below, c) providing force devices capable of independently urging said upper side dam portion and said lower side dam portion of each side dam toward the caster rolls during casting, d) introducing molten steel between the pair of casting rolls to form a casting pool supported on casting surfaces of the casting rolls confined by the side dams, and e) counter-rotating the casting rolls to form solidified metal shells on the surfaces of the casting rolls and cast thin steel strip through the nip between the casting rolls from the solidified shells.

Each lower side dam portion is assembled to have opposite outer surfaces, with one outer surface which is capable of contacting molten metal at the nip, and an opposite outer surface having a fastening portion capable of attaching the lower portion of the side dam to a lower side dam holder to hold the lower portions of the side dam in place during casting. Each lower side dam portion may be confined to the portion of the side dam of greater wear capable of contacting the molten metal adjacent the nip, and may be substantially thicker than the upper side dam portion. For example, the lower side dam portion may be about 30 mm, or more, in height. As a result, the useful life of the overall side dam can be effectively extended.

Alternatively, or in addition, the lower side dam portion may be substantially longer than needed for the operation of the caster, and may be supported to move laterally. By this arrangement, as the lower side dam portion wears, the part of the lower side dam portion capable of being in contact with the molten metal adjacent the nip can be changed by moving the lower portion of the side dam laterally without moving the upper portion of the side dam. Again, the useful life of the overall side dam can be extended by this arrangement.

However arranged, the lower side dam portion may be fastened by refractory fastener portions, extending beyond the outer surface of the lower side dam portion and interacting with attachments portions on a lower side dam holder to position the lower side dam portion. The fastening portions of each lower side dam portion may comprise ceramic pins which are attached into the opposite outer surface portion of each lower side dam portion. The fastening portions hold the lower side dam portions in place without a substantial exposed portion of the lower side dam holder extending beyond the opposite outer surface of the lower portion of the side dam Each upper side dam portion is also assembled to have opposite outer surfaces, with one outer surface capable of contacting the molten metal and the opposite outer surface having fastening portions capable of attaching the upper portion of the side dam to an upper side dam holder to hold the upper portions of the side dams in place during casting. The fastening portions hold the upper side dam portions in place without a substantial exposed portion of the upper side dam holder extending beyond the opposite outer surface of the upper portion of the side dam, and without the upper side dam holder preventing a bottom surface of the upper portion of the side dam from being positioned adjacent to a top surface of the lower portion of the side dam. Each upper side dam portion also may have refractory fasteners extending beyond the opposite outer surface adjacent to a side dam holder. These refractory fasteners of each upper side dam portion and attachment portions of each side dam holder may interact to position the upper side dam portion during casting. The fastening portions of each upper side dam portion may comprise ceramic pins which are attached into the opposite outer surface portion of each upper side dam portion.

Each lower and upper side dam holder may have attachment portions comprising notches, or troughs, into which fastening portions of the lower or upper side dam portion can seat, when the lower or upper side dam portion is attached to the side dam holder for a casting campaign. Alternatively, the lower and upper side dam holders may have attachment portions, which are usually ceramic, that extend into the fastening portions of the lower or upper side dam portions (which are openings in the lower or upper side dam portion), so that the circumferentially exposed portions of the lower and upper side dam holder do not extend substantially beyond the opposite outer surface of the lower or upper side dam portion toward the outer surface capable of contacting the molten metal.

A continuous thin strip casting system is also disclosed with side dam assemblies at each side of the caster. Each side dam assembly comprises a lower side dam portion and an upper side dam portion each having opposite outer surfaces, where one outer surface is capable of contacting molten metal and the opposite outer surface has fastening portions capable of attaching the lower or upper side dam portion to a lower or upper side dam holder to hold the lower or upper side dam portion, respectively, toward the casting rolls during casting. The upper side dam portion and the lower side dam portion are supported independently of each other, and may be capable of being independently driven toward caster rolls of the twin roll caster system.

The side dam assembly further comprises lower and upper side dam holders having attachment portions capable of receiving and supporting the lower or upper side dam portion at the fastening portions, without any exposed portion of the side dam holders extending substantially beyond the opposite outer surfaces of the lower or upper side dam portions toward the outer surfaces capable of contacting molten metal.

The bottom surface of the upper side dam portion is adjacent a top surface of the lower side dam portion, and the lower side dam portion is thicker than the upper side dam portion. The thickness of the lower side dam portion may be at least 20% thicker than the upper side dam portion, and is typically limited to the area of the lower portion of a side dam that experiences the greater wear adjacent the nip. As a result, the thicker lower side dam portion extends the overall operational life of the side dam assembly either by being thicker in the greater wear areas of the side dam in contact with the casting pool, or by being laterally moveable so that new surface areas of the lower side dam portion can be exposed to molten metal as the casting campaign continues, or both, without removing the upper side dam portion.

The side dam assembly may comprise a lower side dam portion having at least one ceramic pin extending outward from the opposite outer surface capable of attaching to the attachment portions of the lower side dam holder and holding the lower side dam portion in place during casting. The lower side dam portion may be longer than needed for contacting the molten metal adjacent the nip and be positioned to move laterally, so that a different area of an outer surface of the lower side dam may be brought into position as the lower portion of the side dam wears during a casting campaign. The side dam assembly may also comprise an upper side dam portion having at least three ceramic pins extending outward from the opposite outer surface capable of attaching to the attachment portions of the side dam holder and holding the upper side dam portion in place during casting. The side dam assembly also may comprise lower and upper side dam holders having notches, or troughs, capable of positioning and supporting the lower or upper side dam portion during casting, without any exposed portion of the side dam holder extending substantially beyond the opposite outer surface of the upper side dam portion toward the surface portion of the lower or upper side dam portion capable of contacting molten metal, and without any portion of the side dam holder preventing a bottom surface of the upper side dam portion from being positioned adjacent to a top surface of a lower side dam portion.

The system and method of continuously casting thin strip, with the disclosed side dam assembly, can extend the length of a casting campaign by as much as 50% or more. The useful life of the side dams can be extended without damage to the casting equipment or risk of bleeding of molten metal from the casting pool damaging to the edges of the cast strip—resulting in termination of the casting sequence. Also, with certain embodiments of the present invention, the positioning of the side dams after preheating by robots is facilitated by assembling the side dams in place for casting, and with certain embodiments of the present invention, the positioning of the lower side dam portion can be done without preheating or without changing the upper side dam portion at the same time, or both.

These and other advantages and novel features of the present invention, as well as details of an illustrated embodiment thereof, will be more fully understood from the following description and drawings.

DETAILED DESCRIPTION OF THE DRAWINGS

Figure 1A:
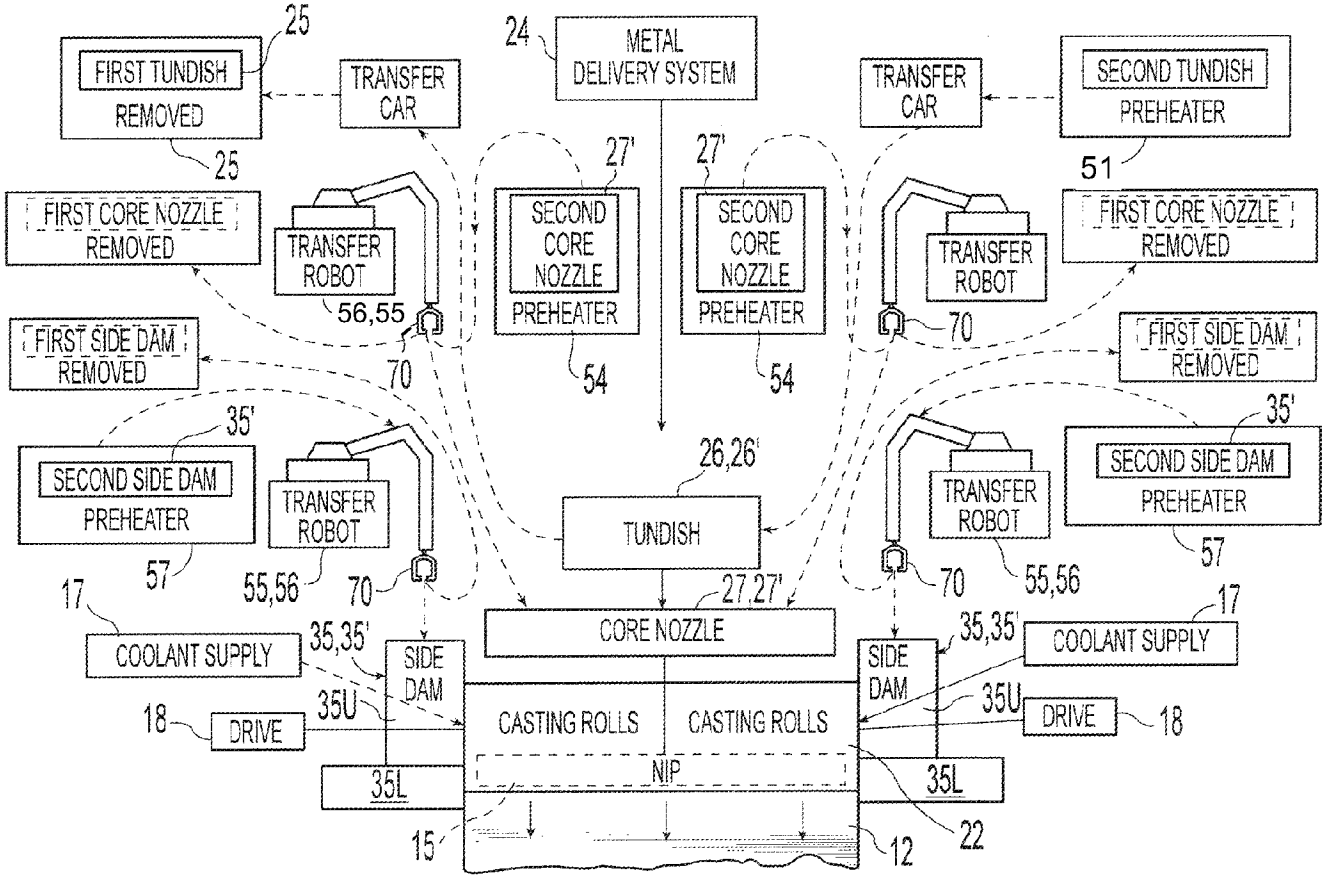
FIGS. 1A-1G illustrate various aspects of an exemplary continuous twin roll caster system in which embodiments of the present invention are used, in accordance with various aspects of the present invention.

FIGS. 1A-1G illustrate various aspects of an exemplary continuous twin roll caster system in which embodiments of the present invention are used, in accordance with various aspects of the present invention.

The illustrative twin roll caster comprises a twin roll caster denoted generally as 11 producing a cast steel strip 12 which passes within a sealed enclosure 10 to a guide table 13, which guides the strip to a pinch roll stand 14 through which it exits the sealed enclosure 10. The seal of the enclosure 10 may not be complete, but appropriate to allow control of the atmosphere within the enclosure and access of oxygen to the cast strip within the enclosure as hereinafter described. After exiting the sealed enclosure 10, the strip may pass through other sealed enclosures and may be subjected to in-line hot rolling and cooling treatment forming no part of the present invention.

Twin roll caster 11 comprises a pair of laterally positioned casting rolls 22 forming a nip 15 therebetween, to which molten metal from a ladle 23 is delivered through a metal delivery system 24. Metal delivery system 24 comprises a tundish 25, a removable tundish 26 and one or more core nozzles 27 which are located above the nip 15. The molten metal delivered to the casting rolls is supported in a casting pool 16 on the casting surfaces of the casting rolls 22 above the nip 15.

The casting pool of molten steel supported on the casting rolls is confined at the ends of the casting rolls 22 by a pair of first side dams 35 each including an upper side dam portion 35U and a lower side dam portion 35L as shown in FIG. 1A. The upper side dam portion 35U attaches to a side dam holder and is positioned adjacent to the lower side dam portion 35L. A bottom surface of the upper side dam portion 35U may be capable of sliding laterally relative to a top surface of the lower side dam portion 35L in a direction toward the casting rolls 22.

Figure 1B:
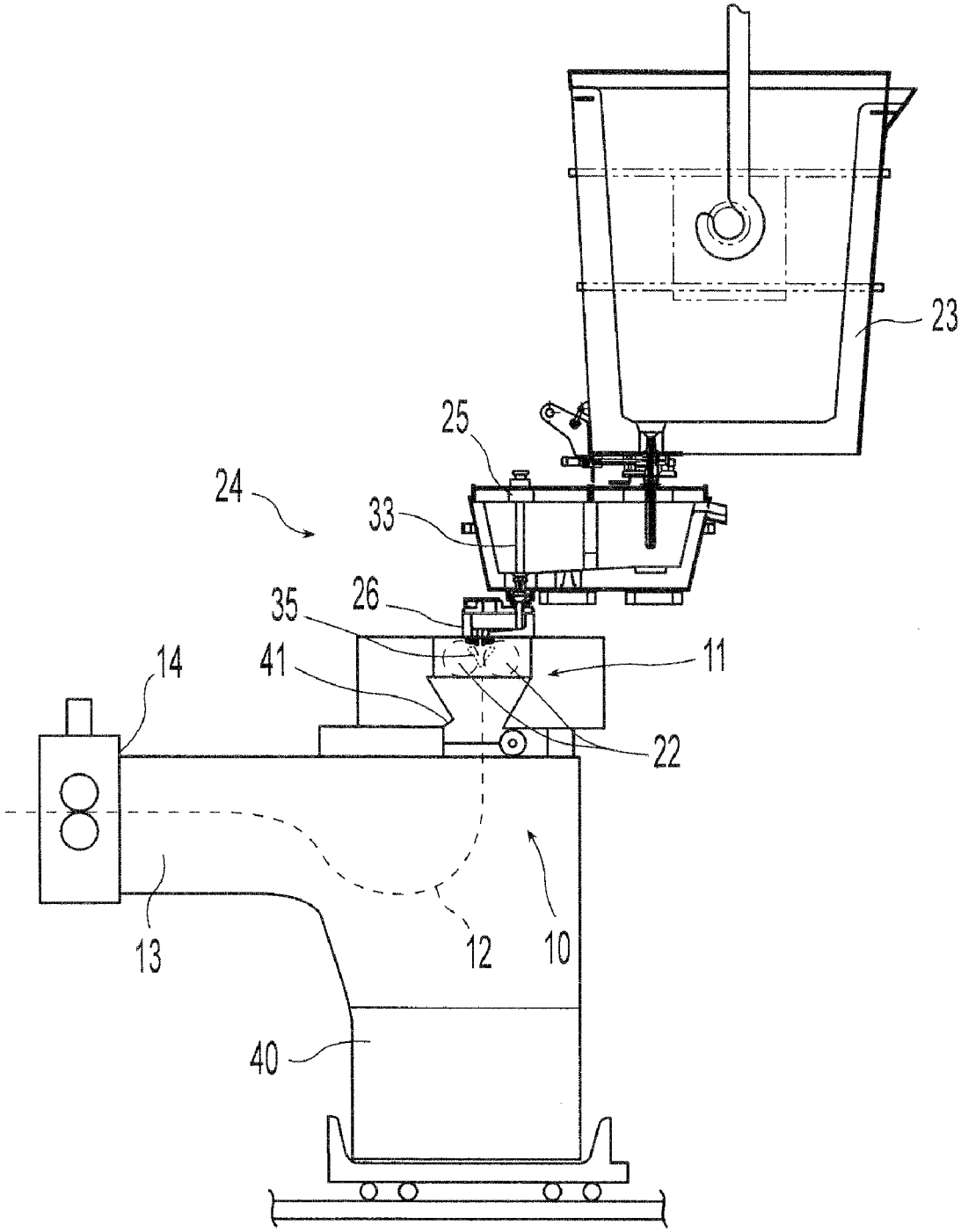
Figure 1C:
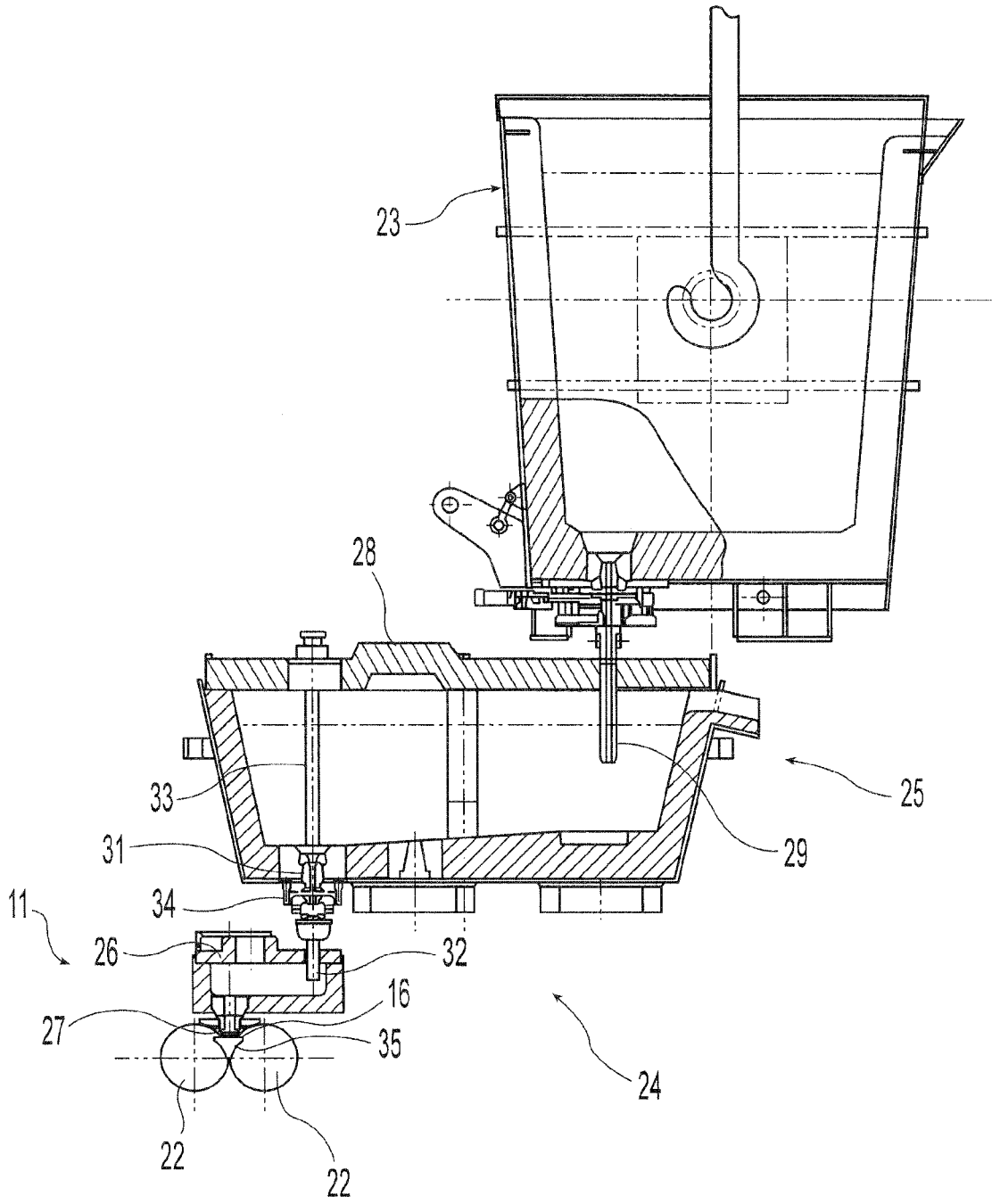
Figure 1D:
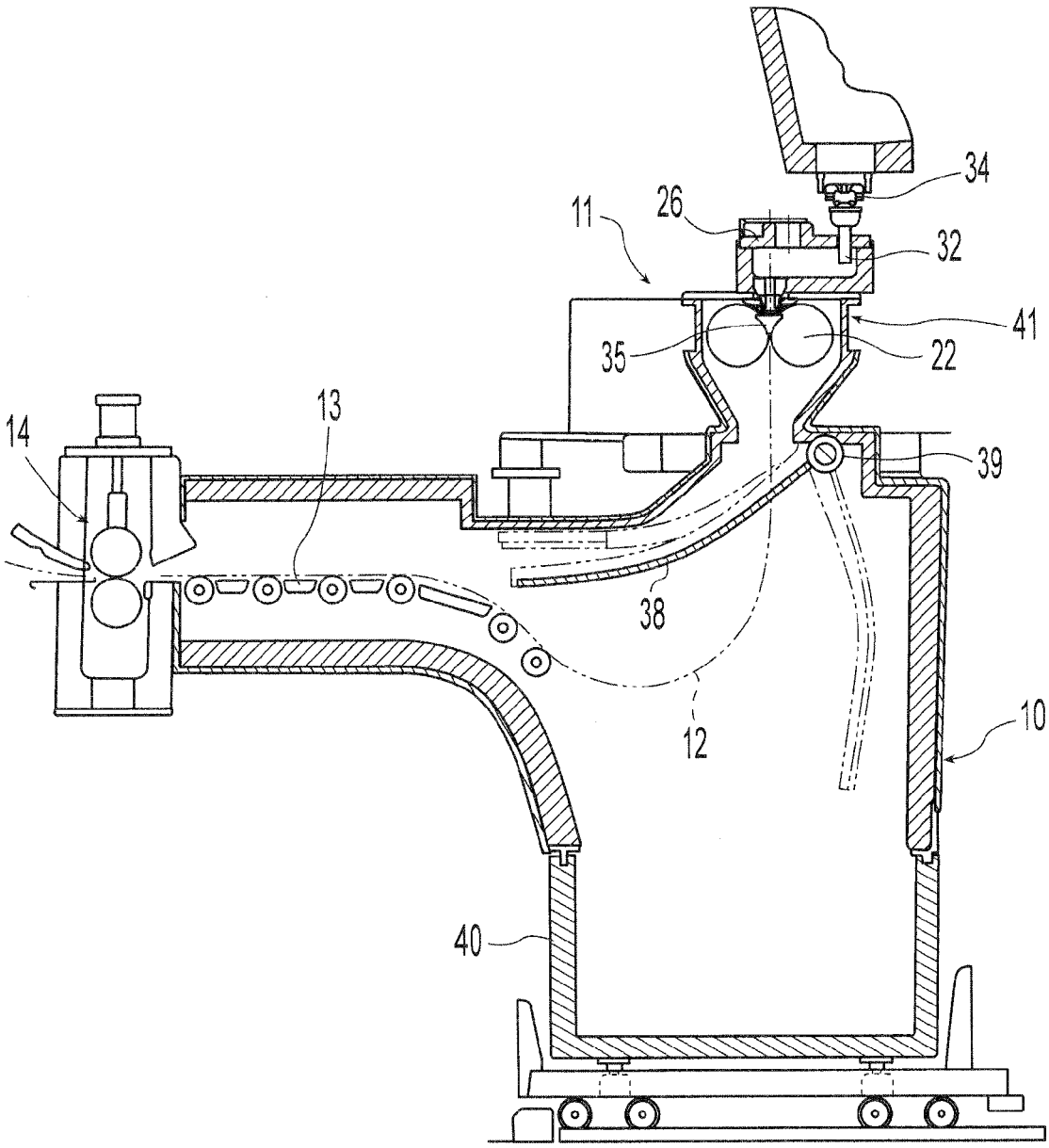
Figure 1E:
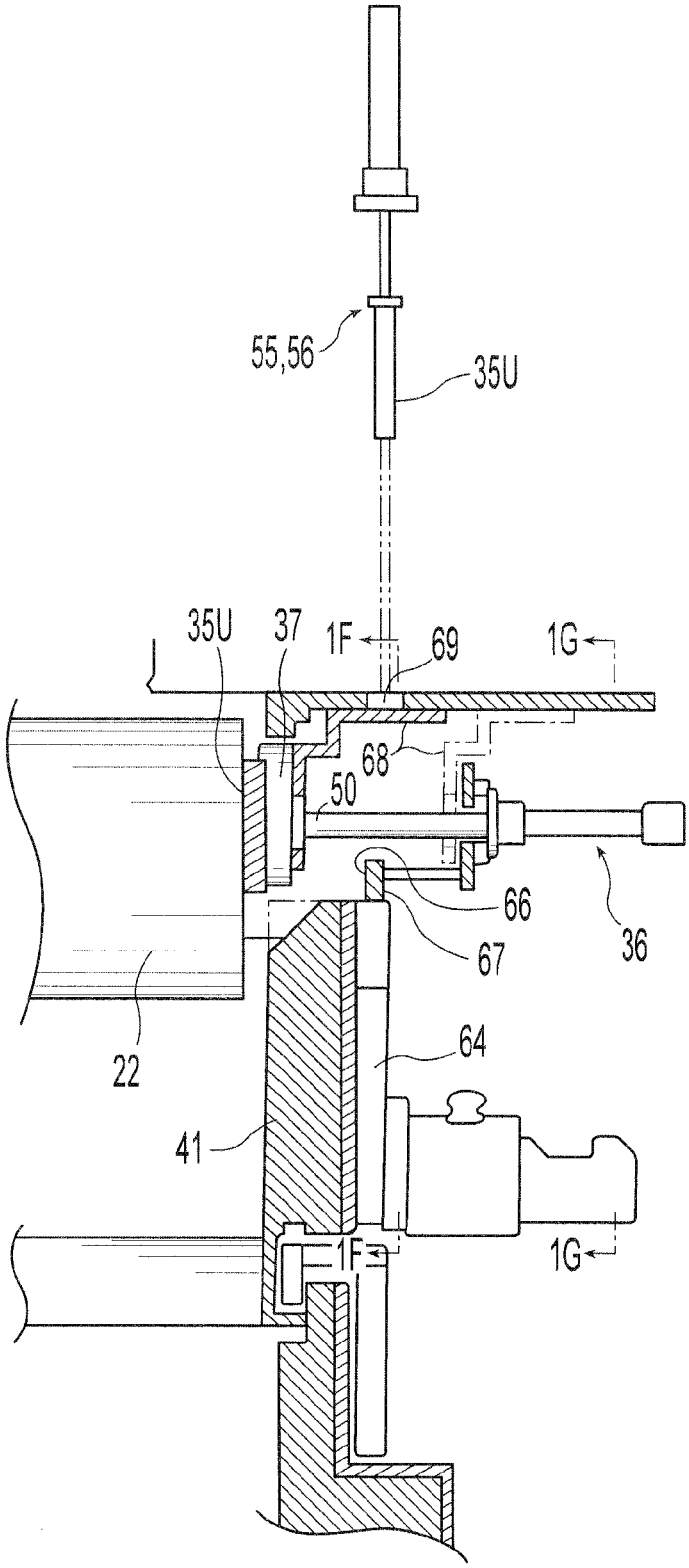
Figure 1F:
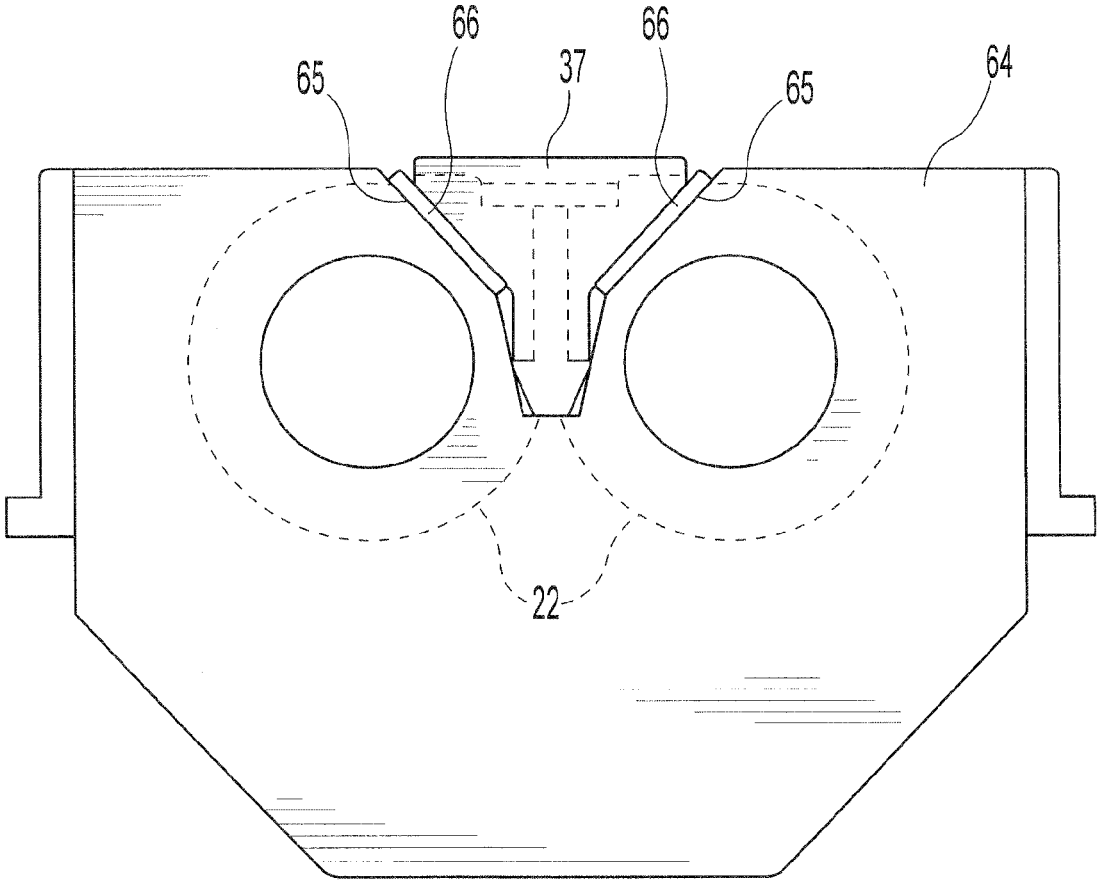
Figure 1G:
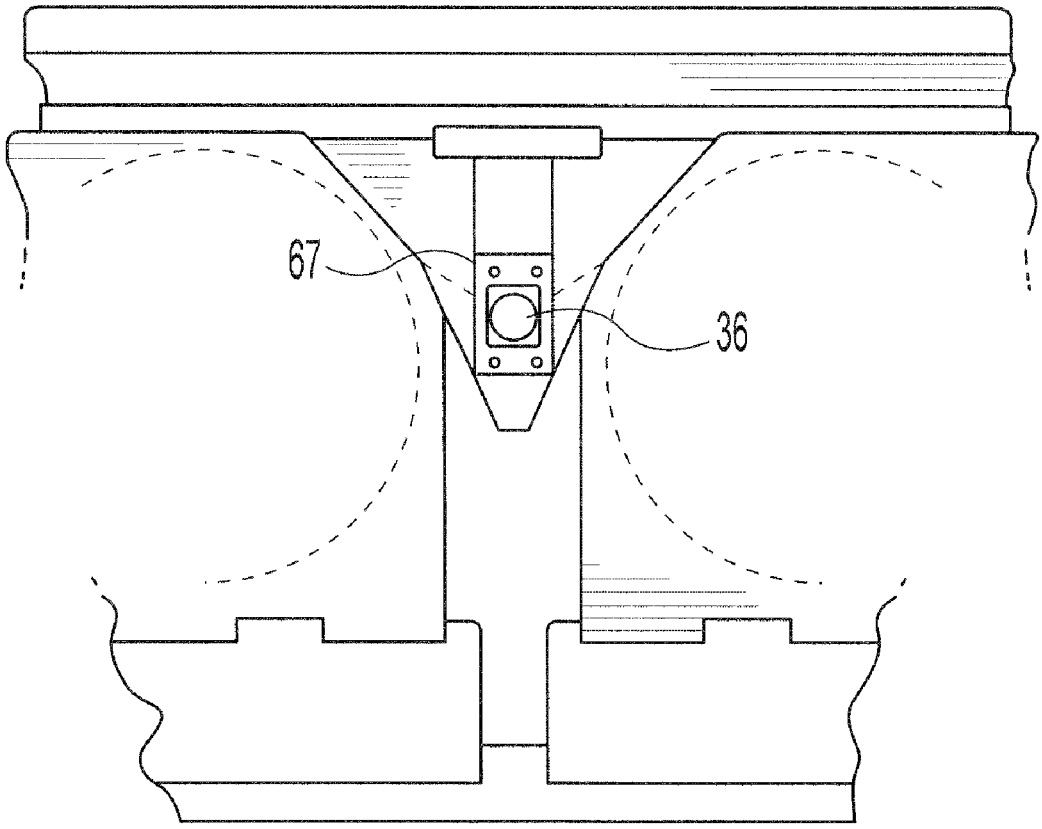

The side dams 35 may be applied to stepped ends of the rolls by operation of force devices such as, for example, hydraulic cylinder units 36 acting through thrust rods 50 connected to side dam holders. In accordance with an embodiment of the present invention, the upper side dam portion 35U and the lower side dam portion 35L are each independently driven by separate hydraulic cylinder units 36. As the upper side dam portion 35U and lower side dam portion 35L wear at different rates during a casting operation, the side dam portions 35U and 35L may be independently adjusted, via the hydraulic cylinder units 36, toward the casting rolls 22, thus extending the useful life of the side dam 35. FIG. 1E illustrates how one hydraulic cylinder unit 36 may be configured with respect to a side dam holder 37 and an upper side dam portion 35U to provide a force device to urge the upper side dam portion 35U toward the casting rolls, in accordance with an embodiment of the present invention. The lower side dam portion 35L and its associated cylinder unit 36 (not shown) may be similarly mounted and positioned, as will be subsequently described herein.

The casting rolls 22 are internally water cooled by coolant supply 17 and driven in counter rotational direction by drives 18, so that metal shells solidify on the moving casting roll surfaces as the casting surfaces move through the casting pool 16. These metal shells are brought together at the nip 15 to produce the thin cast strip 12, which is delivered downwardly from the nip 15 between the rolls.

Tundish 25 is fitted with a lid 28. Molten steel is introduced into the tundish 25 from ladle 23 via an outlet nozzle 29. The tundish 25 is fitted with a stopper rod 33 and a slide gate valve 34 to selectively open and close the outlet 31 and effectively control the flow of metal from the tundish to the removable tundish 26. The molten metal flows from tundish 25 through an outlet 31 through an outlet nozzle 32 to removable tundish 26, (also called the distributor vessel or transition piece), and then to core nozzles 27. At the start of a casting operation a short length of imperfect strip is produced as the casting conditions stabilize.

After continuous casting is established, the casting rolls are moved apart slightly and then brought together again to cause this leading end of the strip to break away so as to form a clean head end of the following cast strip to start the casting campaign. The imperfect material drops into a scrap box receptacle 40 located beneath caster 11 and forming part of the enclosure 10 as described below. At this time, swinging apron 38, which normally hangs downwardly from a pivot 39 to one side in enclosure 10, is swung across the strip outlet from the nip 15 to guide the head end of the cast strip onto guide table 13, which feeds the strip to the pinch roll stand 14. Apron 38 is then retracted back to its hanging position to allow the strip to hang in a loop beneath the caster, as shown in FIGS. 1B and 1D, before the strip passes to the guide table where it engages a succession of guide rollers.

The twin roll caster illustratively may be of the kind which is illustrated in some detail in U.S. Pat. Nos. 5,184,668 and 5,277,243, and reference may be made to those patents for appropriate constructional details which form no part of the present invention.

The first enclosure wall section 41 surrounds the casting rolls 22 and is formed with side plates 64 provided with notches 65 shaped to snugly receive the side dam plate holders 37 when the pair of upper side dam portions 35U are pressed against the ends of casting rolls 22 by the cylinder units 36. The interfaces between the side dam holders 37 and the enclosure side wall sections 41 are sealed by sliding seals 66 to maintain sealing of the enclosure 10. Seals 66 may be formed of ceramic fiber rope or other suitable sealing material.

Figure 2B:
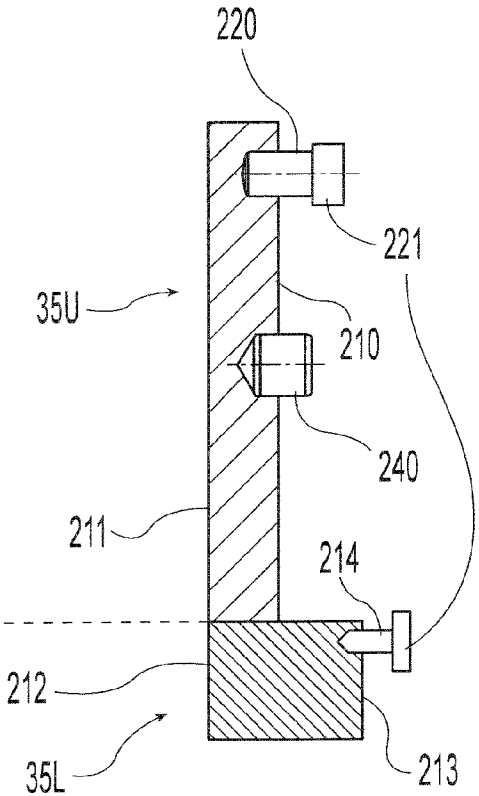
FIGS. 2A-2C illustrate an exemplary embodiment of a side dam, having an upper portion and a lower portion and used in the system of FIGS. 1A-1G, in accordance with various aspects of the present invention.
Figure 2A:
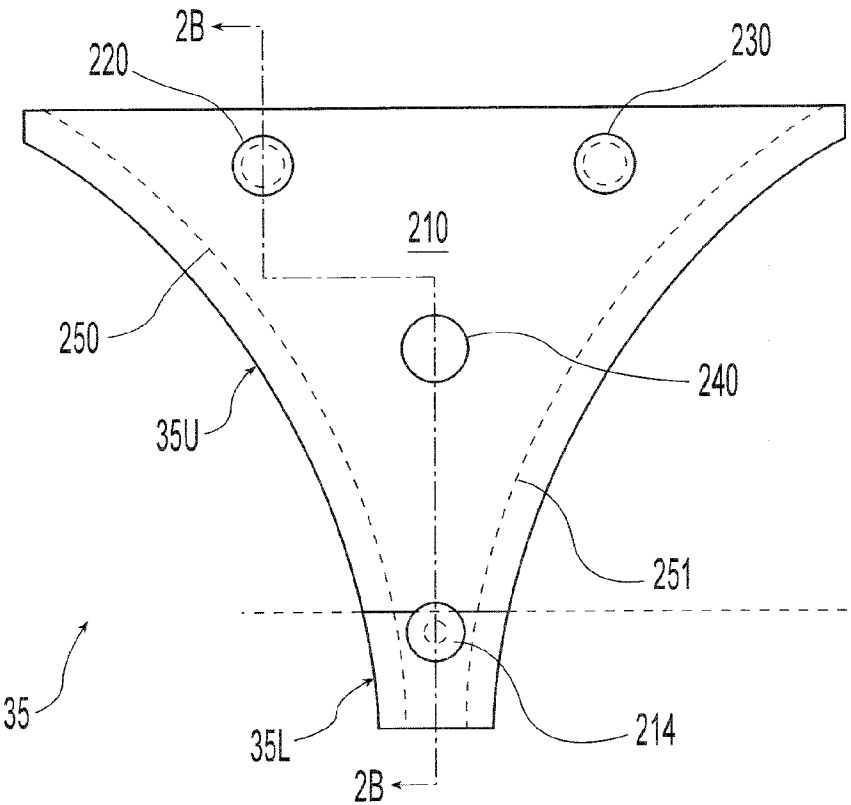
Figure 2C:
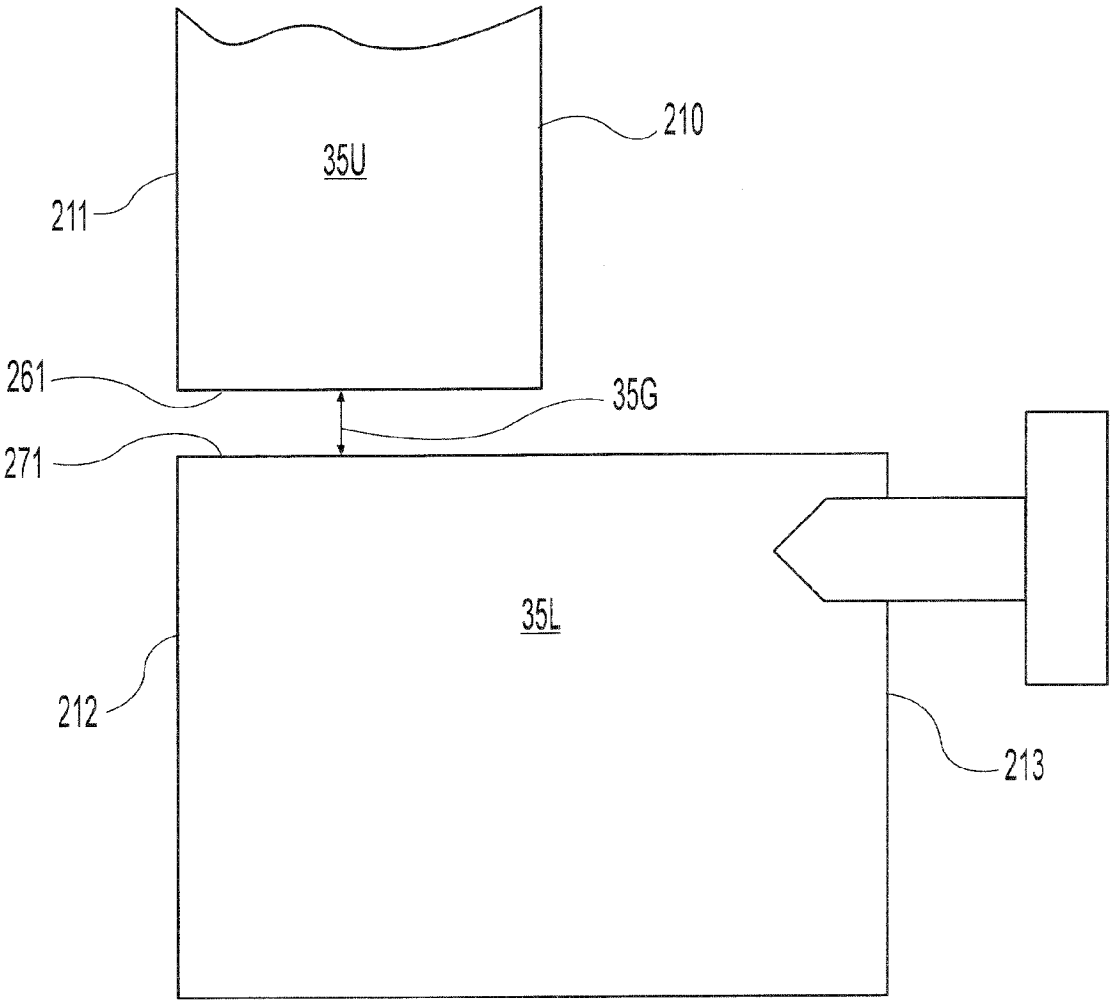

FIGS. 2A-2C illustrate an exemplary embodiment of a side dam 35, having an upper portion 35U and a lower portion 35L, and used in the system of FIGS. 1A-1G. The lower side dam portion 35L includes an outer surface 212, which faces the molten metal and the caster rolls, and an opposite outer surface 213 having one fastening portion 214. The outer surface 212, which may be at least 30 mm in width, is the part of the side dam of greater wear from possible contact with molten metal in the casting pool, and may be at least 20% thicker then the upper side dam portion 35U.

The upper side dam portion 35U includes an outer surface 211 that faces the molten metal and an opposite outer surface 210 having three fastening portions 220, 230, and 240. FIG. 2A is a front view of the side dam 35 and FIG. 2B is a side view of the side dam 35. In accordance with an embodiment of the present invention, the fastening portions 214 and 220-240 are refractory fasteners (e.g., ceramic pins) which are held in place within holes in the lower side dam portion 35L and the upper side dam portion 35U respectively by a refractory adhesive or glue. The refractory fasteners 220-240 and 214 extend outward from the opposite outer surfaces 210 and 213 of the upper side dam portion 35U and the lower side dam portion 35L respectively. Graphite alumina, boron nitride and boron nitride-zirconia composites are examples of suitable refractory materials for the side dams. The dashed lines 250 and 251 of FIG. 2A serve to illustrate where the side dam 35 makes physical contact with the casting rolls when installed in a casting machine, in accordance with an embodiment of the present invention.

There is a gap 35G (see FIG. 2C) that is formed between the bottom surface 261 of the upper side dam portion 35U and the top surface 271 of the lower side dam portion 35L. The side dam configuration is such that the gap 35G does not exceed about 0.2 mm when the upper side dam portion 35U is positioned adjacent to the lower side dam portion 35L during casting. Such a relatively small gap 35G prevents molten metal from seeping through the gap 35G toward the hydraulic machinery. In accordance with an alternative embodiment of the present invention, a refractory sealant may be used within the gap 35G to help prevent molten metal from seeping through the gap 35G and yet allow the lower side dam portion 35L to move laterally relative to the upper side dam portion 35U. Such a sealant may allow the gap 35G to be substantially wider than 0.2 mm. In accordance with a further alternative embodiment of the present invention, worn powder from the side dam 35 serves to seal the gap 35G during casting as the side dam 35 wears.

Figure 3:
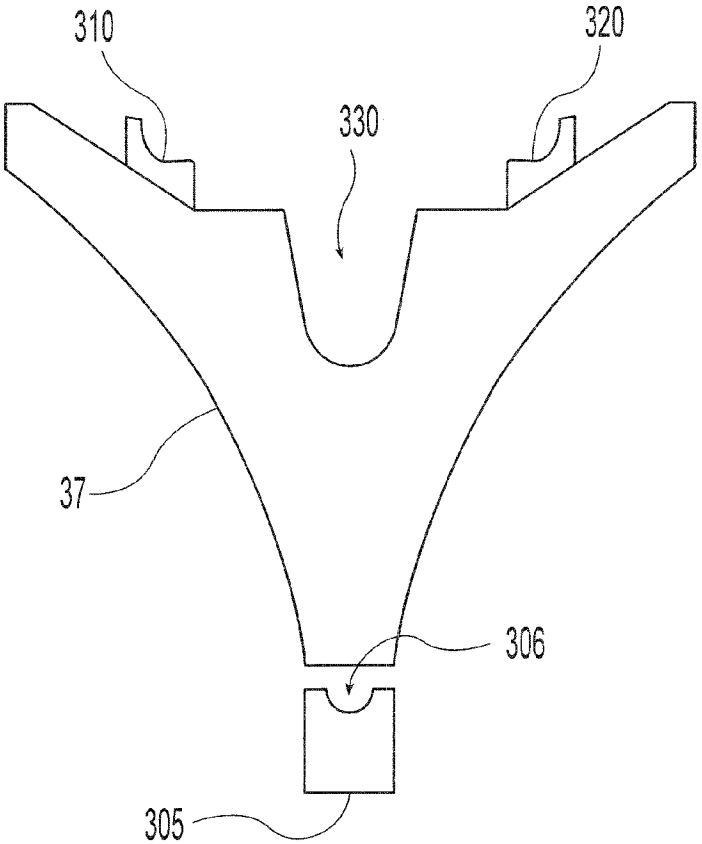
FIG. 3 illustrates an exemplary embodiment of an upper side dam holder and a lower side dam holder, used in the system of FIGS. 1A-1G, in accordance with various aspects of the present invention.

FIG. 3 illustrates an exemplary embodiment of an upper side dam holder 37 and a lower side dam holder 305 for use in the continuous casting system. The side dam holders 37 and 305 are used in the system of FIGS. 1A-1G, in accordance with various aspects of the present invention. The upper side dam holder 37 includes three attachment portions 310, 320, and 330 and the lower side dam holder 305 includes one attachment portion 306. In the embodiment shown in FIG. 3, the attachment portions 306, 310, 320, and 330 are refractory notches or troughs (typically ceramic) that are capable of receiving and supporting the side dam portion 35U and 35L without circumferentially exposed portions of the side dam holders 37 and 305 extending substantially beyond an outer surface of the side dam adjacent the side dam holder, and without any portion of the side dam holders preventing a bottom surface 261 of the upper side dam portion 35U from being positioned adjacent to a top surface 271 of the lower side dam portion 35L which is positioned directly beneath the upper side dam portion 35U.

Alternatively, the side dam holders may have refractory attachment portions, which are usually ceramic, that extend into the fastening portions of the side dam portions (which are openings in the side dam portions), so that the exposed portions of the side dam holders do not extend substantially beyond the opposite outer surface of the side dam toward the outer surface capable of contacting the molten metal.

In accordance with an embodiment of the present invention, the refractory fasteners 220-240 of the upper side dam portion 35U and the attachment portions 310-330 of the side dam holder 37 interact to position the upper side dam portion 35U for casting with respect to the lower side dam portion 35L when the upper side dam portion 35U is seated onto the side dam holder 37 such that the ceramic pins 220-240 rest within the troughs 310-330.

Similarly, in accordance with an embodiment of the present invention, the refractory fastener 214 of the lower side dam portion 35L and the attachment portion 306 of the lower side dam holder 305 interact to position the lower side dam portion 35L for casting with respect to the upper side dam portion 35U when the lower side dam portion 35L is seated onto the side dam holder 305 such that the ceramic pin 214 rests within the trough 306.

The ceramic pins 214, 220, and 230 each include an extension (e.g., a head) 221 which serve to help hold the upper side dam portion 35U secure to the side dam holder 37 at attachment portions 310 and 320, and the lower side dam portion 35L secure to the side dam holder 305 at attachment portion 306. The extensions 221 hang over the attachment portions 310, 320, and 306 such that the upper side dam portion 35U is limited in movement with respect to the side dam holder 37 in a direction lateral to the opposite outer surface 210 of the upper side dam portion 35U, and the lower side dam portion 35L is limited in movement with respect to the side dam holder 305 in a direction lateral to the opposite outer surface 213 of the lower side dam portion 35L. In accordance with an embodiment of the present invention, the fastening portions are refractory glued into the opposite outer surfaces 210 and 213 of the upper side dam portion 35U and the lower side dam portion 35L respectively.

Figure 4:
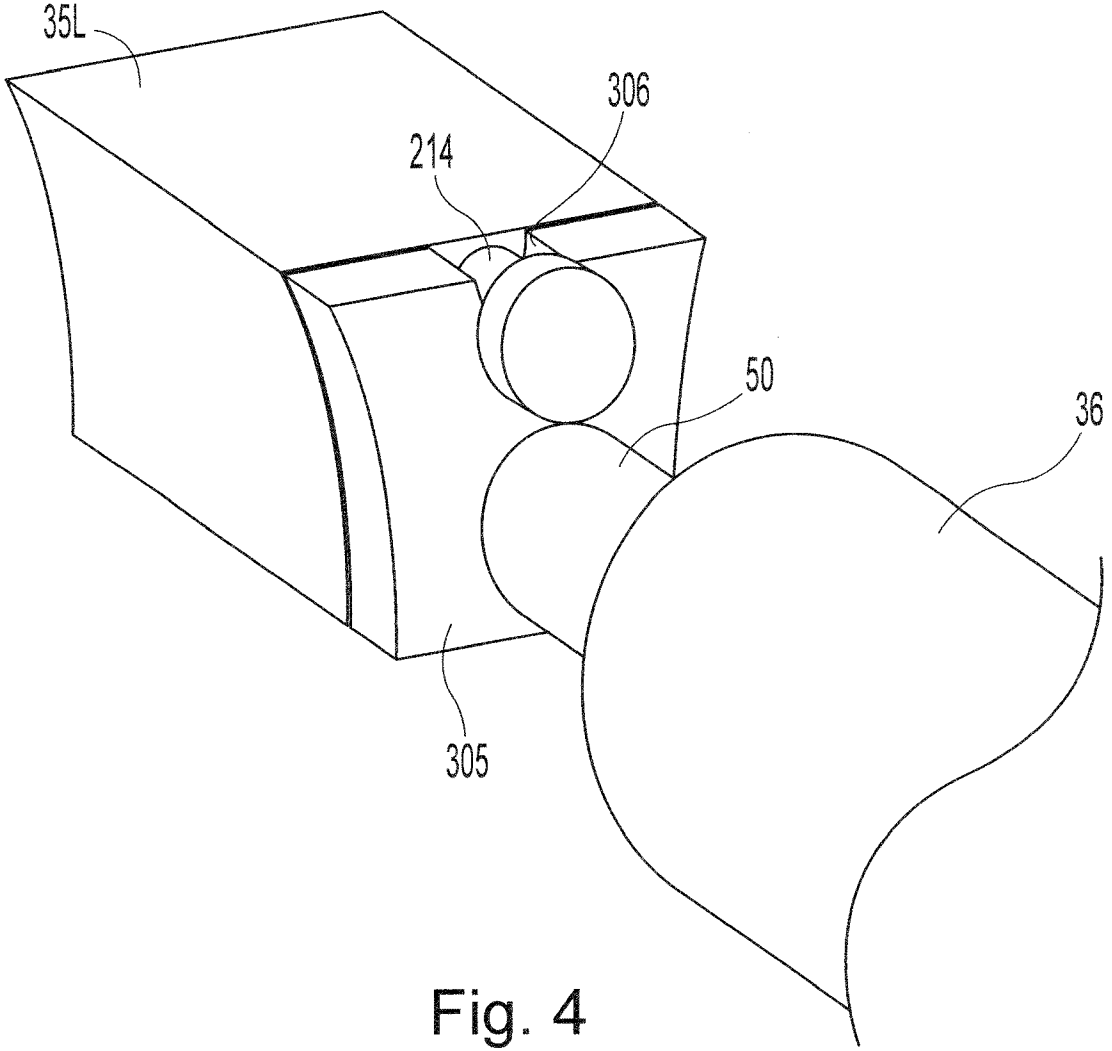
FIG. 4 illustrates an exemplary embodiment of a lower side dam portion attached to a lower side dam holder which is driven by force devices, in accordance with various aspects of the present invention.
Figure 5B:
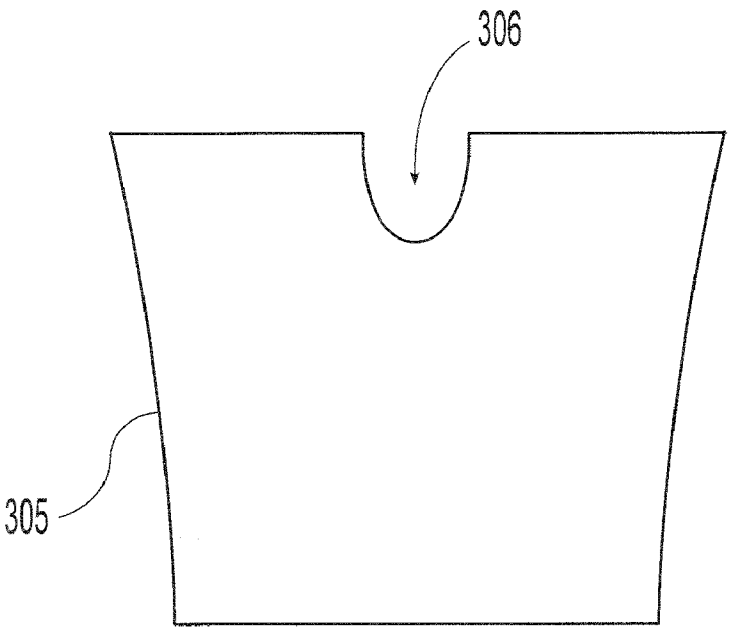
FIG. 5B illustrates a rear view of the embodiment of the side dam holder of FIG. 4, in accordance with various aspects of the present invention.
Figure 5A:
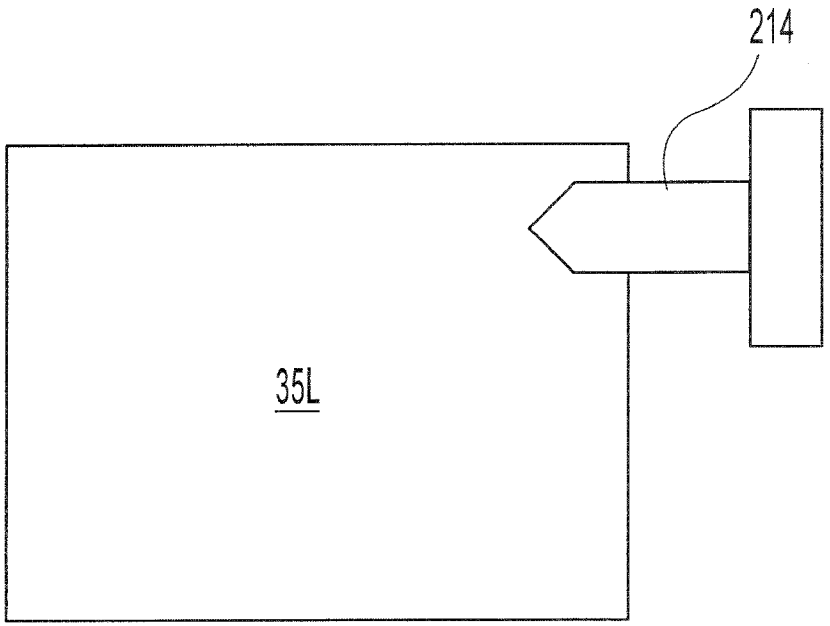
FIG. 5A illustrates a side view of the embodiment of the lower side dam portion of FIG. 4, in accordance with various aspects of the present invention.

FIG. 4 illustrates an embodiment of a lower side dam portion 35L connected to a lower side dam holder 305 which is driven by a force device 36 (e.g., a hydraulic cylinder assembly) to urge the lower side dam portion 35L toward the casting rolls. As previously described, the lower side dam portion 35L includes a fastening portion 214, such as a refractory pin and head, extending from of the opposite outer surface 213 of the lower side dam portion 35L. In accordance with an embodiment of the present invention, the lower side dam holder 305 is a C-clamp configuration having an attachment portion 306 (e.g., a notch or trough) for accepting the fastening portion 214. The lower side dam portion 35L rests onto the lower side dam holder 305 and is held in place when the fastening portion 214 seats within the attachment portion 305. The cylinder assembly 36 is used to drive the lower side dam portion 35L and the lower side dam holder 305 toward the casting rolls, independently of the upper side dam portion 35U and upper side dam holder 37. FIG. 5A illustrates a side view of the embodiment of the lower side dam portion 35L of FIG. 4 and FIG. 5B illustrates a rear view of the embodiment of the side dam holder 305 of FIG. 4.

In accordance with an embodiment of the present invention, the cylinder units 36 extend outwardly through the enclosure wall section 41, and at these locations the enclosure is sealed by sealing plates 67 fitted to the cylinder units so as to engage with the enclosure wall section 41 when the cylinder units are actuated to urge the side dams against the ends of the casting rolls. Cylinder units 36 also move refractory slides 68 which are moved by the actuation of the cylinder units to close slots 69 in the top of the enclosure, through which, for example, the upper side dam portions 35U are initially inserted into the enclosure 10 and into the holders 37 for application to the casting rolls. The top of the sealed enclosure 10 is closed by the tundish 26, the side dam holders 37 and the slides 68 when the cylinder units are actuated to urge the upper side dam portions 35U against the casting rolls 22.

In accordance with an embodiment of the present invention, the lower side dam portions 35L are installed in the caster system before the upper side dam portions 35U and may or may not be pre-heated. Whether preheating is needed will usually depend on the relative area of the outer surface of the lower side dam portion capable of being in contact with the molten metal in the casting pool. The balance is to have the outer area of the lower side dam portion include the regions of greater wear, but being sufficiently small that the area of the outer surface capable of being in contact with the molten metal can be changed without preheating and without substantially disrupting the temperature of the molten metal and inclusion formation in the casting pool.

When it is determined that a change has to be made in any portion of the side dams 35, core nozzle 27 or removable tundish 26 due to wear or any another reason, preheating is commenced of a second refractory component identified to be in need of replacement. This preheating of the second tundish 26' or second core nozzle 27' is started while casting is continuing at least 2 hours before transfer to the operating position, and the preheating of the upper portion of the second side dams 35' is started at least 0.5 hours before transfer to the operating position. This preheating is done in a preheating heater 51, 54 or 57, typically a preheating chamber, in a location convenient to the caster 11, but removed from the operating position of the refractory components during casting. Again, the upper side dam portion of the side dam 35' is pre-heated. The lower side dam portion of the side dam 35' may or may not be similarly pre-heated and transferred, depending on the extent of its surface area capable of being in contact with the molten metal of the casting pool.

During this preheating of the replacement refractory component, casting typically continues without interruption. When the refractory component is to be replaced (e.g., the tundish 26, the core nozzle 27, or the upper side dam portions 35U), the slide gate 34 is closed and the tundish 26, the core nozzle 27 and the casting pool 16 are drained of molten metal. Typically, the tundish 26' and upper side dam portions 35U' are preheated and replaced as individual refractory components, and the core nozzle is preheated and replaced as a singular or two piece refractory component, but in particular embodiments may be preheated and replaced in pieces or parts as those portions of the refractory component are worn.

As an example, referring to FIG. 1A, a pair of transfer robots 55 remove the first upper side dam portions 35U from the operating position, and then a pair of transfer robots 56 transfer the second upper side dam portions of the side dam 35' from the preheating chamber 57 to the operating position. Note that transfer robots 55 and 56 may be the same as shown in FIG. 1A if there is a place for the transfer robots to rapidly set aside the removed first upper side dam portions 35U. However, to save time in removing the upper side dam portions 35U and positioning the second upper side dam portions of the side dam 35' in the operating position, two pairs of transfer robots 55 and 56 may be employed. Following positioning of the second upper side dam portions of the side dam 35' in the operating position, the slide gate 34 is opened to fill the tundish 26 and core nozzle 27 and form casting pool 16, and continue casting. Note that transfer robots 55 and 56 may be the same transfer robots 55 and 56, used to transfer the core nozzles, fitted with a second set gripper arms 70.

In accordance with an embodiment of the present invention, the lower side dam portions 35L may be replaced with lower side dam portions of the side dam 35', with the same transfer robots 55 and 56, before the new preheated upper side dam portions of the side dam 35' are inserted. This will depend, in part, on how the lower side dam portion 35L is mounted and positioned. If lower side dam portion 35L is mounted on an independent lateral movement support, for example, the lower side dam portion 35L may be changed independently of the change of the upper side dam portion 35U without the use of transfer robots. On the other hand, where the increased life of the side dam 35 is provided by increased thickness of the lower side dam portion 35L and the lower side dam portion is preheated and changed by transfer robots, the lower side dam portion may be changed at the same time as the upper side dam portion.

Each transfer robot 52, 55 and 56 is a robot device known to those skilled in the art with gripping arms 70 to grip the core nozzle 27 or 27' typically in two parts, upper side dam portions 35U or second upper side dam portion of the side dam 35' or, if appropriate, the lower side dam portion 35L or second lower side dam portion of the side dam 35'. They can be raised and lowered and also moved horizontally along overhead tracks to move the core nozzle 27', the upper side dam portions 35U and/or the lower side dam portion 35L from a preheating chamber 54 or 57 at a separate location from the operating position to the caster for downward insertion of the plates through the slots 69 into the holders 37.

For example, to change the upper side dam portions 35U, when the molten steel has drained from the metal delivery system and casting pool, slots 69 by the retraction movement of the slides 68, force drives 36 are operated to release the forces on the side dam holders 37 and upper side dam portions 35U, and to bring the upper side dam portions 35U directly beneath the slots 69. Transfer robots 55 may then be lowered such that their gripping arms 70 can grip the upper side dam portions 35U and raised and remove those worn upper side dam portions, which can then be dumped for scrap or refurbishment. The transfer robots 56 are then moved to the preheat chambers where they pick up the replacement upper side dam portions of the side dam 35' and move them into position above the slots 69 and the side dam holders 37. Upper side dam portions of the side dam 35' are then lowered by the transfer robots 56 into the side dam holders, the transfer robots 56 are raised and the cylinder units 36 operated to urge the preheated replacement upper side dam portions of the side dam 35' against the end of the casting rolls 22 and to move the slides 68 to close the enclosure slots 69. The operator then actuates slide gate 34 to initiate resumption of casting by pouring molten steel into tundish 26 and core nozzle 27, to initiate a normal casting operation in a minimum of time. Again, in accordance with an embodiment of the present invention, the lower side dam portions 35L may be replaced with lower side dam portions of the side dam 35' before the new preheated upper side dam portions of the side dam 35' are inserted using the same transfer robots.

The upper side dam portions 35U and/or the lower side dam portions 35L may be removed when they become worn to specified limits as will be explained further below, and may be removed one at a time as worn to a specified limit. During a casting run and at a time interval before the upper side dam portions 35U and/or the lower side dam portions 35L have worn down to an unserviceable level, the wear rate of the side dams 35 may be monitored by sensors, and the preheating of replacement upper side dam portions and/or lower side dam portion of the side dam 35' may be commenced in preheat furnaces at preheating chamber 57 separate from the caster 11. The lower side dam portions 35L will typically be the point most actively monitored because it is the part of the side dam that experiences greater wear.

Figure 6A:
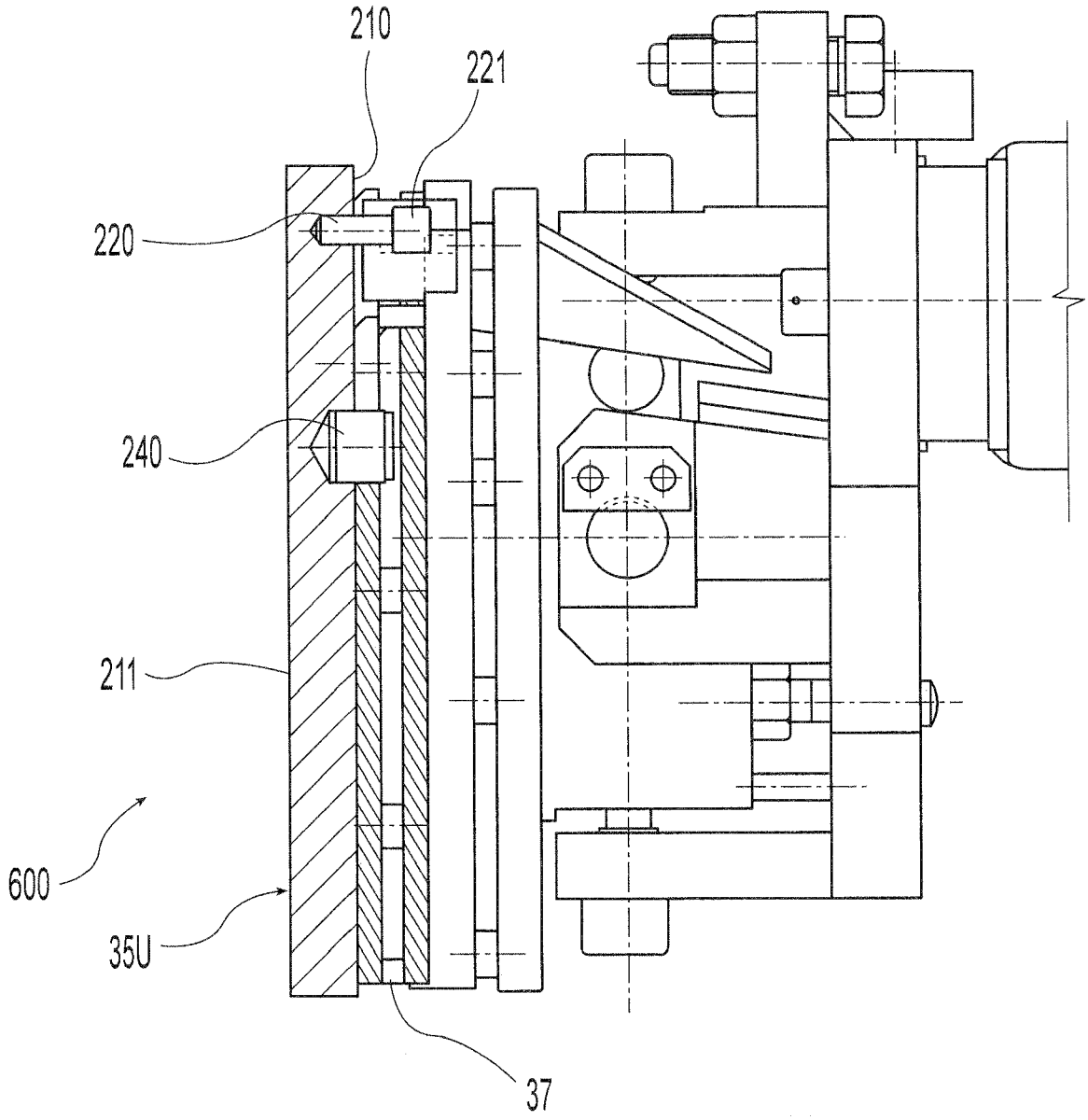
FIGS. 6A-6B illustrate an exemplary embodiment of the upper part of a side dam assembly showing the upper side dam portion of FIGS. 2A-2C and the side dam holder of FIG. 3 and used in the system of FIGS. 1A-1G, in accordance with various aspects of the present invention.
Figure 6B:
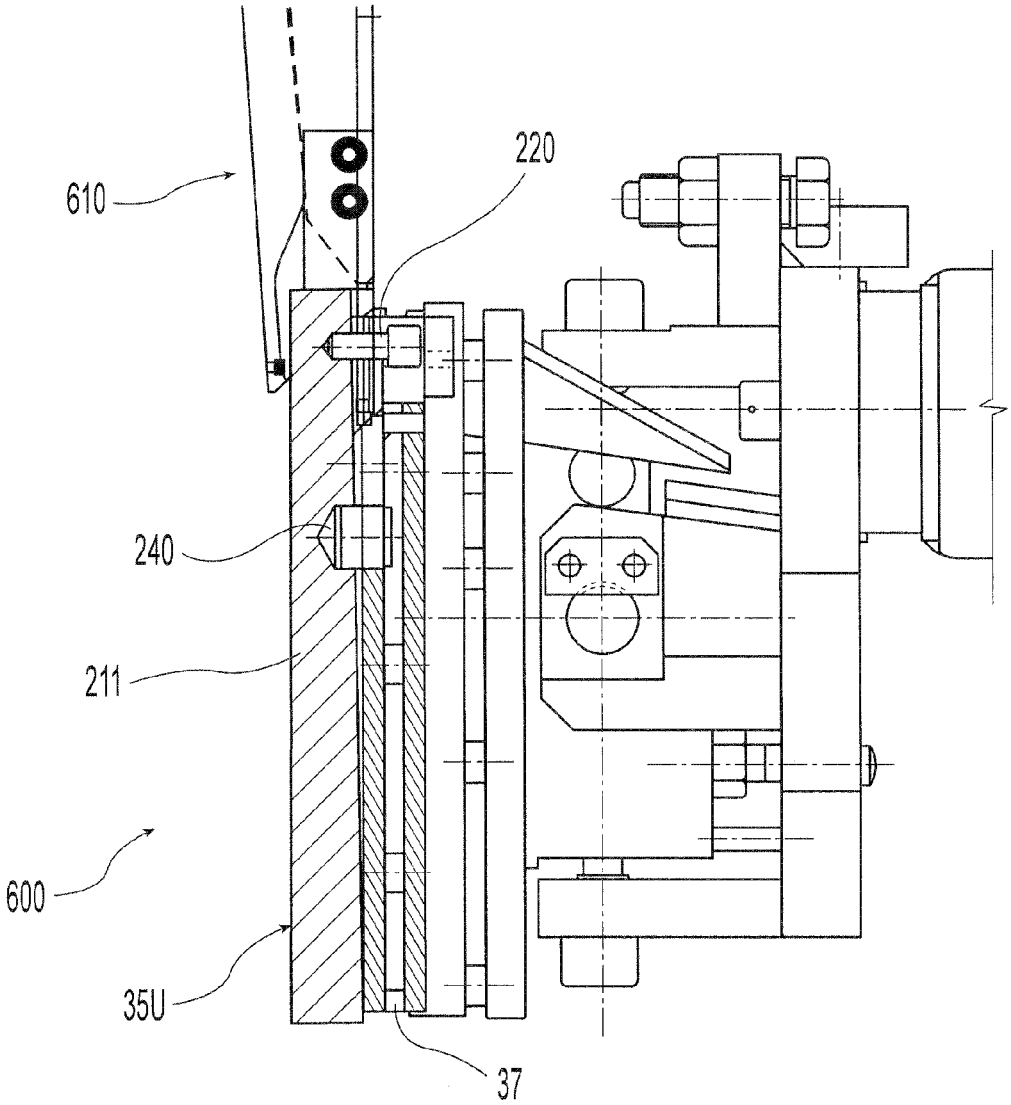

FIGS. 6A-6B illustrate an exemplary embodiment of one section 600 of a side dam assembly showing the upper side dam portion 35U of FIGS. 2A-2B and the side dam holder 37 of FIG. 3 and used in the system of FIGS. 1A-1G, in accordance with various aspects of the present invention. FIG. 6A shows the upper section 600 of a side dam assembly at the cast position. FIG. 6B shows the upper section 600 of side dam assembly at installation using a transfer robot 610. The transfer robot 610 is able to extend downward, grab the upper side dam portion 35U, and pull the upper side dam portion 35U upward to remove the upper side dam portion 35U from the side dam holder 37.

Similarly, the transfer robot 610 is able to set a new upper side dam portion of the side dam 35' down onto the side dam holder 37 as previously described herein. The transfer robot 610 does not have to be as precise in positioning the upper side dam portion 35U with respect to the side dam holder 37 as in prior art configurations. The configuration of the upper side dam portion 35U and side dam holder 37 is more forgiving with respect to positioning. Other machinery holds the side dam holder 37 in place.

In the cast position, the upper side dam portion 35U is positioned tightly against the side dam holder 37. No exposed portion of the side dam holder 37 extends substantially beyond the opposite outer surface 210 toward the outer surface 211 of the upper side dam portion 35U capable of contacting molten metal. Furthermore, no exposed portion of the side dam holder 37 interferes with or prevents the upper side dam portion 35U from being positioned slidably adjacent to the lower side dam portion 35L and forming a limited gap 35G therebetween. Such a configuration allows for the side dam 35 to be used longer for casting and wear more before having to be replaced. Any or all of the fastening portions 220-240 may also be allowed to wear as the casting process proceeds, in accordance with various embodiments of the present invention.

Figure 7B:
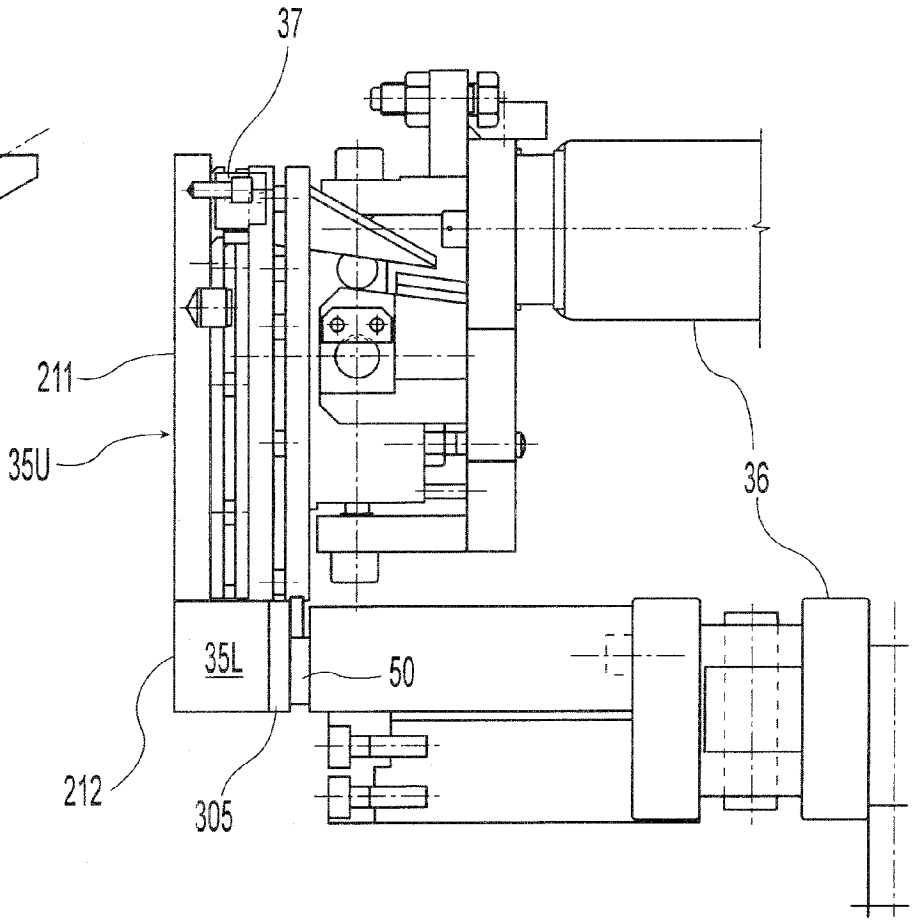
FIGS. 7A-7B illustrate an exemplary embodiment of a side dam assembly comprising the side dam holders of FIG. 3 and the upper and lower side dam portions of FIGS. 2A-2C and used in the system of FIGS. 1A-1G, in accordance with various aspects of the present invention.
Figure 7A:
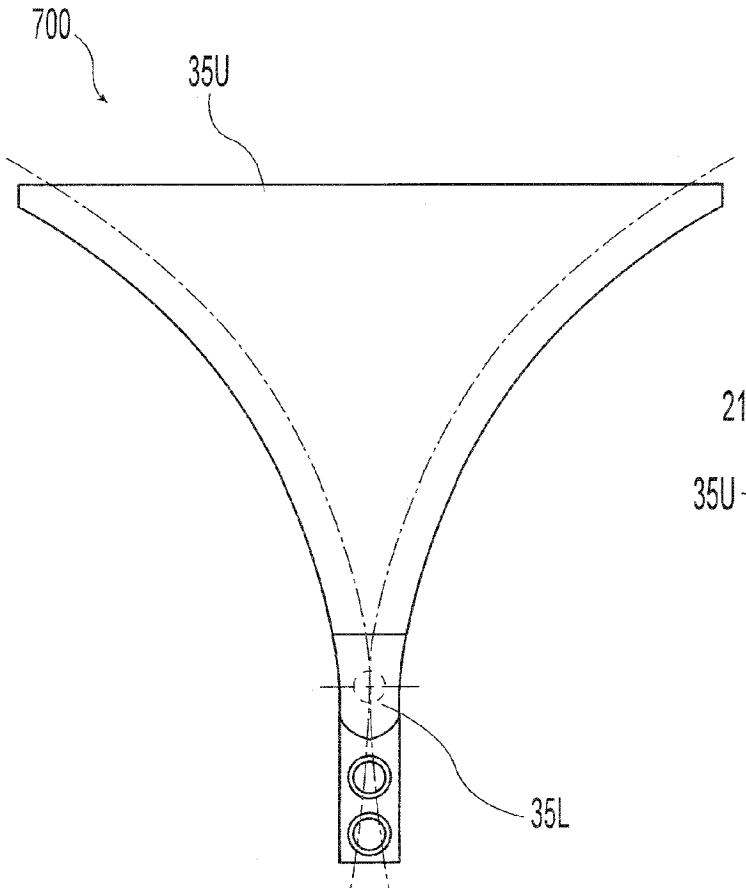

FIGS. 7A-7B illustrate an exemplary embodiment of a side dam assembly 700 comprising the side dam holder 37 of FIG. 3 and the upper and lower side dam portions 35U and 35L of FIGS. 2A-2C and used in the system of FIGS. 1A-1G, in accordance with various aspects of the present invention. FIG. 7A shows a front view of the side dam assembly 700 and FIG. 7B shows a side view of the side dam assembly 700 along with certain force device positioning machinery 36 which urge the upper side dam portion 35U and the lower side dam portion 35L independently toward the caster rolls. Such hydraulic machinery 36 also holds the side dam holder 37 and 305 in place, in accordance with an embodiment of the present invention.

It may be desirable to replace a side dam or dams 35 when worn to specified limits, such as when the dam(s) become or will become unserviceable. For example, the wear of the side dams may be monitored by means of load/displacement transducers or sensors mounted on cylinders 36. The cylinders will generally be operated so as to impose a relatively high force on the side dams 35 during an initial bedding-in period in which there will be a higher wear rate after which, the force may be reduced to a normal operating force. The output of the displacement transducers on cylinders 36 can then be analyzed by a control system, usually including a computerized circuit, to establish a progressive wear rate and to estimate a time at which the wear will reach a level at which the side dams 35 become unserviceable. The control system is responsive to the sensors to determine the time at which preheating of replacement side dams should be initiated prior to interrupting the cast for replacement of the side dams. The upper side dam portion 35U and the lower side dam portion 35L are monitored separately, in accordance with an embodiment of the present invention, and may, therefore, be determined to have worn out at different times.

As an example, the monitoring is performed by a sensor such as, for example, an optical sensor or an electrical sensor. At least a portion of a side dam is replaced when the sensor reveals that the side dam is worn to specified limits. In accordance with an embodiment of the present invention, a stock for wear of the lower side dam portion may be at least 20 percent thicker than a stock for wear of the upper side dam portion. Alternatively, the lower side dam portion could be made of a different material that is more wear resistant. Since the lower side dam portion is relatively small, a more expensive refractory material may be used for that portion of the side dam. In accordance with an alternative embodiment of the present invention, a stock for wear of the lower side dam portion is at least two times thicker than a stock for wear of the upper side dam portion.

A method of producing thin cast strip by continuous casting using the system of FIGS. 1A-1G with the side dam assembly of FIGS. 7A-7B, may include assembling a pair of casting rolls, having a nip therebetween, assembling a metal delivery system comprising side dams adjacent the ends of the nip to confine a casting pool of molten metal supported on casting surfaces of the casting rolls, where each side dam has a lower portion positioned adjacent to an upper portion, where each portion has opposite outer surfaces, one surface capable of contacting the molten metal and the opposite surface having fastening portions capable of attaching that portion to a side dam holder to hold the portions of the side dams in place during casting. No circumferentially exposed portion of the side dam holder extends substantially beyond the opposite outer surface of the portion of the side dam, and no portion of the side dam holder prevents a bottom surface of the upper portion of the side dam from being positioned adjacent to a top surface of the lower portion of the side dam. Force devices are provided which independently urge the upper side dam portion and the lower side dam portion of each side dam toward the casting rolls during casting. Molten steel is introduced between the pair of casting rolls to form a casting pool supported on casting surfaces of the casting rolls confined by the side dams, and the casting rolls are counter-rotated to form solidified shells on the surfaces of the casting rolls and cast thin steel strip through the nip between the casting rolls from the solidified shells In summary, certain embodiments of the present invention provide a side dam assembly for a continuous twin roll caster system. The side dam assembly includes a side dam having an upper portion positioned adjacent to a lower portion. Each of the upper portion and the lower portion have an outer surface that faces toward the molten metal, and an opposite outer surface having at least one fastening portion extending outward from the opposite outer surface and capable of attaching the upper and lower side dam portions to respective side dam holders at the opposite outer surfaces, in order to hold the upper and lower side dam portions in place during casting. The side dam assembly also includes two side dam holders having attachment portions capable of receiving and supporting the upper and lower portions of the side dams, respectively, at the fastening portions, without any portion of the side dam holders extending substantially beyond the opposite outer surfaces toward the outer surfaces of the upper and lower portions of the side dams capable of contacting molten metal, and without any portion of the side dam holders preventing a bottom surface of the upper portion of the side dam from being positioned adjacent to a top surface of the lower portion of the side dam. The upper side dam portion and the lower side dam portion may each be independently driven toward the caster rolls via force devices, in accordance with an embodiment of the present invention.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

What is claimed is:

1. A method of producing thin cast strip by continuous casting comprising the steps of:

a) assembling a pair of casting rolls having a nip therebetween, b) assembling a metal delivery system comprising side dams adjacent the ends of the nip to confine a casting pool of molten metal supported on casting surfaces of the casting rolls, where each side dam has an upper portion and an adjacent lower portion, and where said upper portion and said lower portion each have opposite outer surfaces, one surface capable of contacting the molten metal and the opposite surface having fastening portions capable of attaching that portion of the side dam to a side dam holder to hold said portions of said side dams in place during casting, without circumferentially exposed portions of each said side dam holder extending beyond said opposite outer surface of said portion of said side dam to support said side dam, and without any portion of said side dam holder preventing a bottom surface of said upper portion of said side dam from being positioned adjacent to a top surface of said lower portion of each said side dam, c) providing force devices capable of independently urging said upper side dam portion and said lower side dam portion of each side dam toward the caster casting rolls during casting, d) introducing molten steel between the pair of casting rolls to form a casting pool supported on casting surfaces of the casting rolls confined by said side dams; and e) counter-rotating the casting rolls to form solidified metal shells on the surfaces of the casting rolls and cast thin steel strip through the nip between the casting rolls from said solidified shells.

2. The method of producing thin cast strip by continuous casting as claimed in claim 1 where the lower side dam portion having at least 30 mm in width and capable of being in contact with molten metal adjacent the upper side dam portion.

3. The method of producing thin cast strip by continuous casting as claimed in claim 1 where each said fastening portion of each said upper portion and lower portion of said side dams comprise refractory fasteners extending beyond said opposite outer surface adjacent to a side dam holder.

4. The method of producing thin cast strip by continuous casting as claimed in claim 3 where said refractory fasteners of each said upper portion and lower portion of said side dams and attachment portions of each side dam holder interact to position the upper portion and lower portion of the side dam adjacent each other and allowing independent urging of the upper portion and lower portion of each said side dam toward the casting rolls during casting.

5. The method of producing thin cast strip by continuous casting as claimed in claim 1 where said fastening portions of each said upper portion and lower portion of said side dams comprise refractory pins attached into said opposite outer surface of said upper portion or lower portion of each said side dam.

6. The method of producing thin cast strip by continuous casting as claimed in claim 1 where each side dam holder has attachment portions comprising notches on which said fastening portions of a corresponding upper portion or lower portion of a side dam can seat when the upper portion and lower portion of the side dam is attached to the side dam holder.

7. The method of producing thin cast strip by continuous casting as claimed in claim 1 where each side dam holder has attachment portions that extend into the fastening portions which are openings in the upper or lower portions of the side dam, to provide that exposed portions of the side dam holder do not extend beyond the opposite outer surfaces of the upper and lower portions of the side dam toward the outer surfaces capable of contacting the molten metal.

8. The method of producing thin cast strip by continuous casting as claimed in claim 7 where the extending attachment portions of the side dam holder are ceramic.

9. The method of producing thin cast strip by continuous casting as claimed in claim 1 where a gap between said bottom surface of said upper portion and said top surface of said lower portion does not exceed about 0.2 mm when said upper portion is positioned adjacent to said lower portion for casting.

10. The method of producing thin cast strip by continuous casting as claimed in claim 1 where said lower portion is at least two times thicker than said upper portion.

11. The method of producing thin cast strip by continuous casting as claimed in claim 1 where said lower portion is at least 20 percent thicker than said upper portion.

* * * * *

UNITED STATES PATENT AND TRADEMARK OFFICE

CERTIFICATE OF CORRECTION

PATENT NO. : 7,975,755 B2
APPLICATION NO. : 12/364840
DATED : July 12, 2011
INVENTOR(S) : Mike Schueren It is certified that error appears in the above-identified patent and that said Letters Patent is hereby corrected as shown below:

Column 1, line 7, “May 9, 2006” should read --May 19, 2006--.
Column 1, line 63, delete extra paragraph break included.
Column 10, line 37, “52, 55 and 56” should read --55 and 56--.

Column 13, line 63, “the caster casting” should read --the casting--.

Signed and Sealed this
Twentieth Day of March, 2012

David J. Kappos

David J. Kappos
*Director of the United States Patent and Trademark Office*